US005864317A

United States Patent [19]

Boe et al.

[11] Patent Number: 5,864,317

[45] Date of Patent: Jan. 26, 1999

[54] SIMPLIFIED QUADRANT-PARTITIONED ARRAY ARCHITECTURE AND MEASURE SEQUENCE TO SUPPORT MUTUAL-COUPLING BASED CALIBRATION

[75] Inventors: Eric N. Boe, Long Beach; Gib Lewis, Manhattan Beach, both of Calif.

[73] Assignee: Raytheon Company, Lexington, Mass.

[21] Appl. No.: 862,688

[22] Filed: May 23, 1997

[51] Int. Cl.[6] ..... H01Q 3/24

[52] U.S. Cl. ..... 342/374; 342/368

[58] Field of Search ..... 342/368, 372, 342/374, 153

[56] References Cited

U.S. PATENT DOCUMENTS 3,883,870 5/1975 Kunz ..... 342/174

4,823,136 4/1989 Nathanson et al. ..... 342/368

5,717,405 2/1998 Quan ..... 342/373

*Primary Examiner*—Ian J. Lobo

*Attorney, Agent, or Firm*—Leonard A. Alkov; Glenn H. Lenzen, Jr.

[57] ABSTRACT

A quadrant-partitioned array architecture and measurement sequence supporting mutual-coupling based calibration. The architecture includes an array of radiating elements grouped into quadrants, with a quadrant feed network and an intra-quadrant feed network connected between a transmitter/receiver and the radiating elements. The architecture includes test signal switches which provide access for quadrant testing functions, allowing a test signal to be injected into one quadrant while making measurements of the received signal in an adjacent quadrant. Mutual coupling based module-to-module RF measurements are performed to phase up the array.

2 Claims, 9 Drawing Sheets

FIG. 6.

| | | | | | | | | | |
|---|---|---|---|---|---|---|---|---|---|
| 1 | 2 | 1 | 2 | 1 | 6 | 7 | 6 | 7 | 6 |
| 11 | 12 | 11 | 12 | 11 | 16 | 17 | 16 | 17 | 16 |
| 1 | 2 | 1 | 2 | 1 | 6 | 7 | 6 | 7 | 6 |
| 11 | 13 | 11 | 13 | 11 | 16 | 17 | 16 | 17 | 16 |
| 1 | 2 | 1 | 2 | 1 | 6 | 7 | 6 | 7 | 6 |
| 51 | 52 | 51 | 52 | 51 | 56 | 57 | 56 | 57 | 56 |
| 61 | 62 | 61 | 62 | 61 | 66 | 67 | 66 | 67 | 66 |
| 51 | 52 | 51 | 52 | 51 | 56 | 57 | 56 | 57 | 56 |
| 61 | 62 | 61 | 62 | 61 | 66 | 67 | 66 | 67 | 66 |
| 51 | 52 | 51 | 52 | 51 | 56 | 57 | 56 | 57 | 56 |

SIMPLIFIED QUADRANT-PARTITIONED ARRAY ARCHITECTURE AND MEASURE SEQUENCE TO SUPPORT MUTUAL-COUPLING BASED CALIBRATION

TECHNICAL FIELD OF THE INVENTION

This invention relates to phased array antenna systems, and more particularly to a quadrant-partitioned array architecture and measurement sequence that will allow for mutual-coupling based calibration.

BACKGROUND OF THE INVENTION

One of the most time and resource consuming steps in the making of an electronically scanned array antenna is the calibration of its elements with respect to each other. All of the elements across the array must be calibrated to a known amplitude and phase to form a beam. This process is referred to as array phase-up.

Conventional phase-up techniques typically require the use of external measurement facilities such as a nearfield range to provide a reference signal to each element in receive and to measure the output of each element in transmit. As all the elements must be operated at full power to provide the full transmit plane wave spectrum to sample, a great deal of energy is radiated during this testing. This dictates some implementation of high RF power containment, and carries with it a number of safety concerns.

Known array mutual coupling phase up techniques have been dependent on two dimensional symmetric lattice arrangements (equilateral triangular) and equal element mutual coupling responses in all lattice orientations. These are serious limitations since equilateral triangular lattice arrangements are not always used. Similarly, the element mutual coupling response is most often not equal in all lattice orientations.

Previous discussions of array self-calibration have noted the need for separate transmit and receive feeds to support the simultaneous transmit/receive operation required for calibration.

SUMMARY OF THE INVENTION

In accordance with one aspect of the invention, a phased array antenna is described, which includes an array of radiating elements arranged in a regular, rhombic lattice in first, second, third and fourth quadrants. A plurality of transmit/receive (T/R) modules are provided, each being connected to a corresponding one of the radiating elements. A reciprocal quadrant feed network divides a feed signal into separate feed signals for each quadrant, and includes first, second, third and fourth quadrant feed transmission lines which take RF signals to and from each quadrant. Reciprocal intra-quadrant feed networks for each quadrant are connected between the quadrant feed network and the T/R modules associated with a given quadrant, wherein each intra-quadrant feed network divides the quadrant feed signal into feed signals for each T/R modules comprising the corresponding quadrant. First, second, third and fourth quadrant test signal switches are connected respectively in the first, second, third and fourth feed transmission lines to provide a switch function to selectively interrupt one or more of said feed transmission lines and to provide instead signal paths to a test signal generator for array self phase-up.

In accordance with a second aspect of the invention, a method is described for calibrating a phased array antenna, comprising a sequence of the following steps:

providing an array of radiating elements, arranged in a regular, rhombic lattice in first, second, third and fourth quadrants, each radiating element connected to a corresponding transmit/receive module;

providing a reciprocal quadrant feed network for dividing a feed signal into separate feed signals for each quadrant, and for combining quadrant receive signals into an array receive signal, the quadrant feed network including first, second, third and fourth quadrant feed transmission lines which take RF signals to and from each quadrant;

providing a reciprocal intra-quadrant feed network for each quadrant, each for dividing a quadrant feed signal into corresponding T/R module feed signals, and for combining signals received at a radiating element in the quadrant and passed through the T/R modules of the quadrant into a quadrant receive signal;

providing first, second, third and fourth quadrant test signal switches connected respectively in the first, second, third and fourth feed transmission lines to provide a switch function to selectively interrupt one or more of said feed transmission lines and to provide instead signal paths to a test signal generator;

phasing-up the radiating elements by a calibration sequence comprising injecting a test signal into one of said test signal switches for a given quadrant to drive one or more radiating elements in said quadrant, and receiving signals radiating as a result of said test signal in two or more radiating elements in another quadrant, measuring said received signals to phase-up said two or more radiating elements and their associated T/R modules, and repeating the sequence for the other radiating elements to phase-up the array.

In an exemplary embodiment, the radiating elements are arranged in rows and columns of elements, and the step of phasing up the radiating elements comprises:

for each quadrant, phasing up alternating radiating elements and associated T/R modules within each said row;

for each quadrant, phasing up alternating radiating elements and associated T/R modules within each said column;

for each quadrant, phasing up the radiating elements and associated T/R modules within each said column;

for each quadrant, phasing up all radiating elements and associated T/R modules within the quadrant;

phasing up all the radiating elements and associated T/R modules within the first and second quadrants to form a phased up first half-array, and phasing up all the radiating elements and associated T/R modules within the third and fourth quadrants to form a phased up second half-array; and completing the phasing up of the array by phasing up the first and second half-arrays.

This technique allows for transmit/receive array modules to be used for array self-calibration, and for only quadrant partitioning of the array feeds. Modern, monopulse radars have such feeds already, so the addition of test accesses or switches to the feeds will be all that is required to support the calibration.

BRIEF DESCRIPTION OF THE DRAWING

These and other features and advantages of the present invention will become more apparent from the following detailed description of an exemplary embodiment thereof, as illustrated in the accompanying drawings, in which:

FIG. 6 depicts the array of FIG. 4 after completion of step two of the exemplary calibration process.

DETAILED DESCRIPTION OF THE PREFERRED EMBODIMENT

Figure 1A:
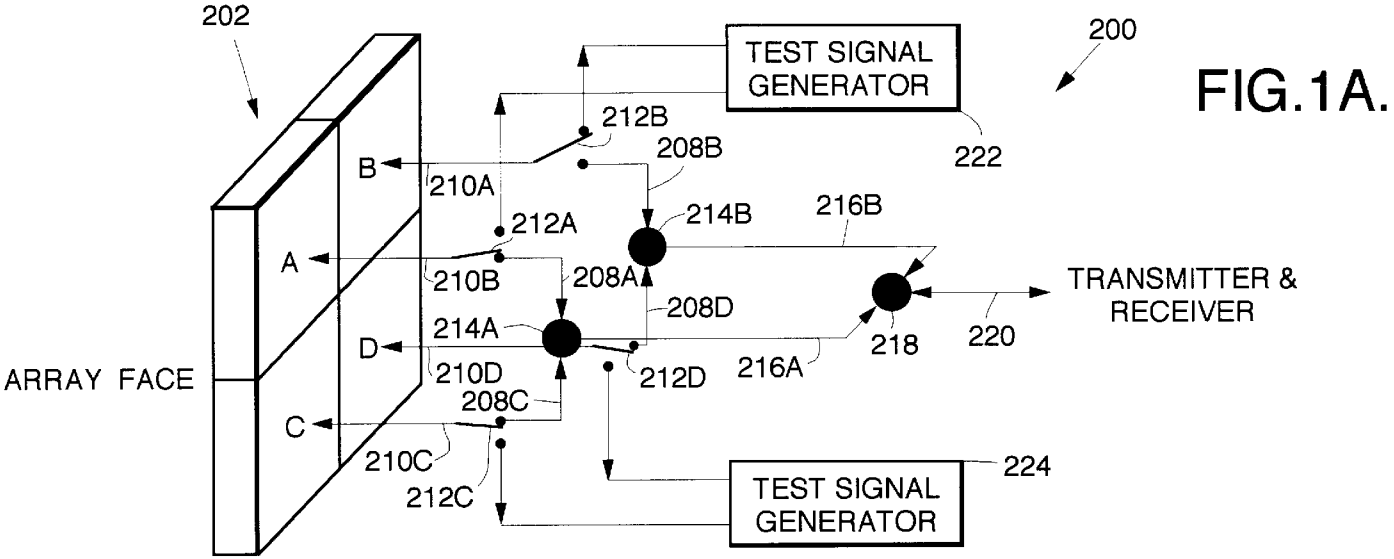
FIG. 1A is a schematic diagram of an array and feed architecture with quadrant partitioning in accordance with the invention.

FIG. 1A is a schematic illustration of an exemplary antenna system 200 employing a phased array and feed architecture with quadrant partitioning. It will be understood that other system architectures can be used in accordance with the invention. The array includes the array face 202 which includes an assembly of radiating elements, a transmit/receive (T/R) module behind each element (active phased arrays), a phase shifter and an attenuator (optional). The array 200 further includes reciprocal intra-quadrant feed networks 210A–210D, switches 212A–212D for quadrant test access, cabling 208A–208D, a pair of combiners/dividers or monopulse hybrids 214A–214B, a half-array feed comprising cabling 216A and 216B, another combiner or monopulse hybrid 218, and a final cabling 220 to the radar transmitter and receiver.

Each intra-quadrant feed network 210A–210D is represented schematically in FIG. 1A as a line, but is a feed network for dividing a quadrant feed signal into corresponding T/R module feed signals for connection to the T/R modules corresponding to a given quadrant. Feed networks for distributing feed signals between a source and the array T/R modules are well known in the art, and can utilize equal amplitude distributions, or more typically some sort of amplitude tapering to achieve a desired array beam shape.

The devices 214A, 214B, and 218 function as a quadrant feed network to divide a signal from a transmitter connected to cabling 220 into four quadrant feed signals for connection to corresponding intra-quadrant feed networks 210A–210D.

The intra-quadrant feed networks 210A–210B and the quadrant feed network formed by devices 214A, 214B and 218 are reciprocal, in that the networks function to divide a transmit signal at cabling 220 into respective T/R feed signals for connection to the T/R modules comprising the array face, or to combine signals received at the radiating elements and passed through the T/R modules into a combined receive signal at cabling 220.

Test signals are generated by test signal generators 222 and 224, and can be selectively switched into the array intra-quadrant feeds at switches 212A and 212B and switches 212C and 212D.

Figure 1B:
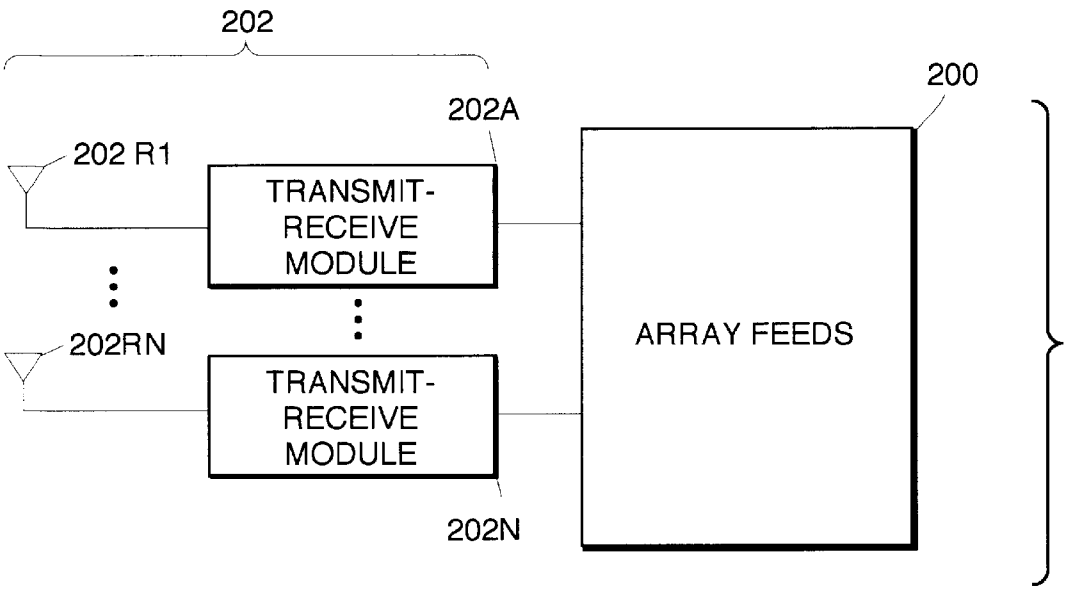
FIG. 1B shows a general configuration of the T/R modules and radiating elements comprising the array face 202.

FIG. 1B shows a general configuration of the T/R modules 202A–202N and radiating elements 202R1–202RN comprising the array face 202.

Figure 1C:
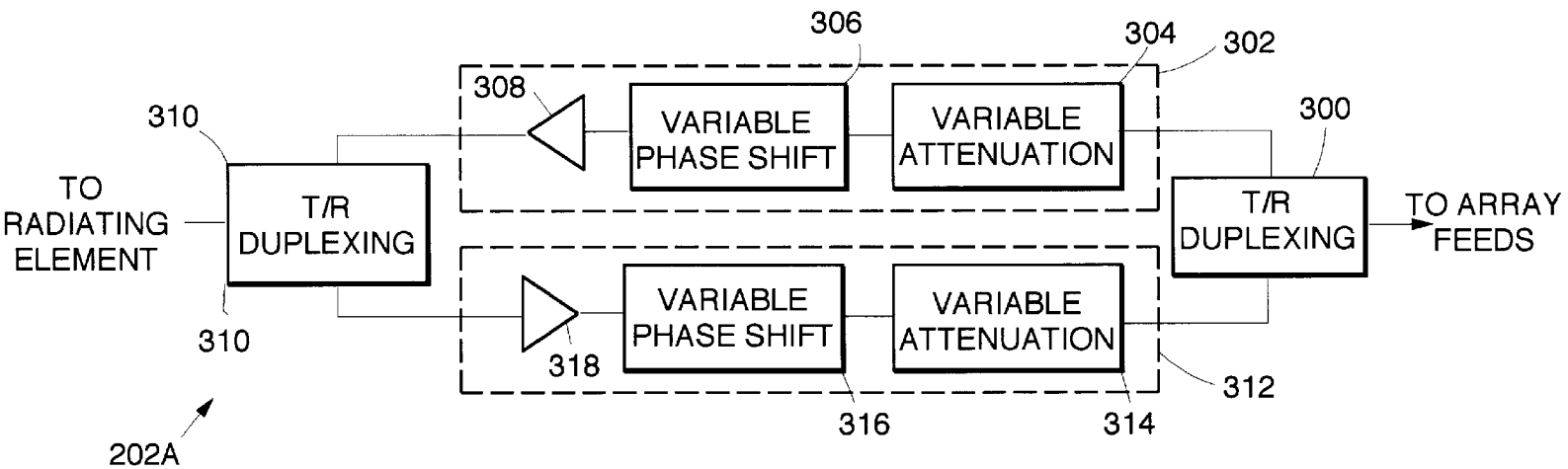
FIG. 1C is a schematic block diagram illustrating an exemplary T/R module.

FIG. 1C is a schematic block diagram illustrating exemplary T/R module 202A. Each T/R module in this exemplary embodiment includes T/R duplexing circuit 300 for providing a connection between the transmit and receive channels 302, 312 of the module to the array feed 200. The duplexing circuit 300 provides a means of routing signals from the transmitter to the transmit channel, and routing signals received at the radiating element 202R1 and passes through the receive channel of the module to the system receiver.

The transmit channel 302 includes variable attenuation 304, variable phase shift circuit 306, and high power amplifier 308. The receive channel 312 includes low noise amplifier 318, variable phase shift circuit 316, and variable attenuation 314. T/R/duplexing circuit 310 can take the form of a circulator and provides a means of routing signals received at the radiating element 202R1 into the receive channel 312, and routing transmit signals from the transmit channel 302 to the radiating element 202R1.

The radiating elements are arranged in a regular, rhombic lattice, such as diamond and square lattice structures. Each radiating element must exhibit two-fold symmetry in its mutual coupling characteristic to the surrounding elements. In the case of an active phased array, the T/R modules must include provision for a high isolation, high protection "off" state to allow for high SNR, mutual-coupling based measurements. This can be accomplished by powering down all active devices in the T/R module, with protection provided by a switch or limiter in the duplexer 310.

The feeds which take RF signals to and from each quadrant have test access added, e.g. by way of switches 212A–212D. This will be used to inject a transmit signal from a signal generator 222 or 224 into one quadrant while making measurements of the received signal in an adjacent quadrant. This function can be accomplished with a switch function as shown in FIG. 1A, or through some other T/R duplexing technique.

The techniques of making mutual-coupling based phase up measurements are described in commonly assigned pending applications, "ACTIVE ARRAY SELF CALIBRATION," Ser. No. 08/643,132, filed May 2, 1996, and "SELF-PHASE UP OF ARRAY ANTENNAS WITH NON-UNIFORM ELEMENT MUTUAL COUPLING AND ARBITRARY LATTICE ORIENTATIONS," Ser. No. 08/642,033, filed May 2, 1996, the entire contents of which are incorporated herein by this reference. Additionally, the examples given below are for a receive calibration case. This does not exclude the ability for transmit calibration, as reciprocity holds. A brief summary of coupling-based calibration is included below.

The technique for making a mutual-coupling based calibration measurement focuses on the ability to use one element of a phased array as a signal source to several other elements of the lattice. With a common signal source, and common phase and amplitude signal propagation from the element, two or more elements may be adjusted to achieve a common phase and reference amplitude.

Figure 2:
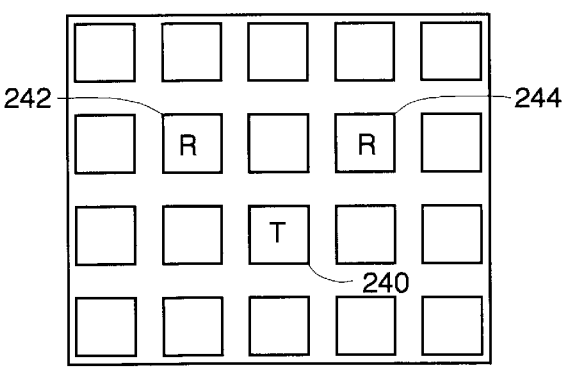
FIG. 2 is a schematic illustration of a first type of coupling-based measurement, wherein two symmetric modules in the array receive signals transmitted from another module, and the receiving modules are adjusted to match in a complex sense.

Two types of coupling-based measurements are used in the calibration process. The first of these two measurements is to simply measure two symmetric modules, i.e. two modules placed equidistant from the reference transmitting element along either the E-plane or the H-plane, and to adjust the phase shifter and attenuator of one of the modules until the two measured signals match in a complex sense. FIG. 2 depicts such a measurement, wherein one module 240 is used in a transmit mode as the signal source, and symmetric modules 242 and 244 measure resulting signals.

Figure 3:
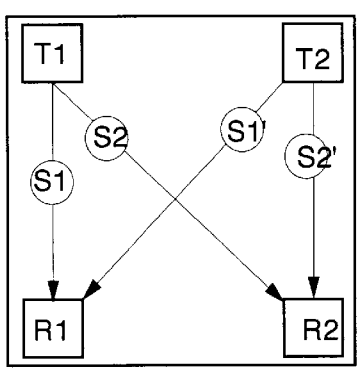
FIG. 3 is a schematic illustration of a second type of coupling-based measurement, wherein a set of interleaved, phased up lattices are phased with respect to each other.

The second type of coupling-based measurement is critical to completing the phase-up process. After using the symmetric element phase-up process illustrated in FIG. 2, a set of interleaved, phased-up lattices exist. This step then phases up these lattices with respect to each other. Instead of making a simple pair of measurements, a total of four signals are measured. A ratio of ratios of these measurements is formed to resolve the non-symmetric coupling ambiguity. FIG. 3 depicts the required measurements. Here, the phased up lattices are depicted as lattices T1, T2, R1 and R2. Four signals S1, S2, S1' and S2' are measured, with a ratio of ratios of these measurements calculated.

The mathematics of deriving the phase and gain corrections from the above two types of measurements are included in the above-referenced pending applications, as is a more detailed description of the techniques just summarized.

The following illustrates a representative measurement sequence, a calibration sequence that correctly phases all of the modules together. This measurement sequence is merely exemplary, and other sequences can be derived which involve fewer steps and allow for more reduction of measurement error effects.

A receive calibration example is discussed below. Reciprocity applies, and transmit calibration can also be achieved by reversing the roles of the transmit and receive elements.

For each of the measurements detailed below for the receive example, a transmit signal is injected into one quadrant of the array via the special test access switches 212A–212D (FIG. 1). The level of the transmit signal is adjusted such that the received signal, conveyed via mutual coupling to the receive module, is within the linear operational range of the receive module's circuitry.

In all measurements, all modules except for the transmit reference module and the receive module under test are set to the modules' high isolation, high protection state. This is done to minimize competing leakage signals which can corrupt the RF measurement. It is also done to assure the protection of the modules not involved in the precise measurement from receiving a damaging transmit reference signal input.

For the receive measurements, the measurement point is at the receive port of the array at cabling 220. By doing so, the phase-up of the post-quadrant feeds and hybrids can be included in the measurement.

Figure 4:
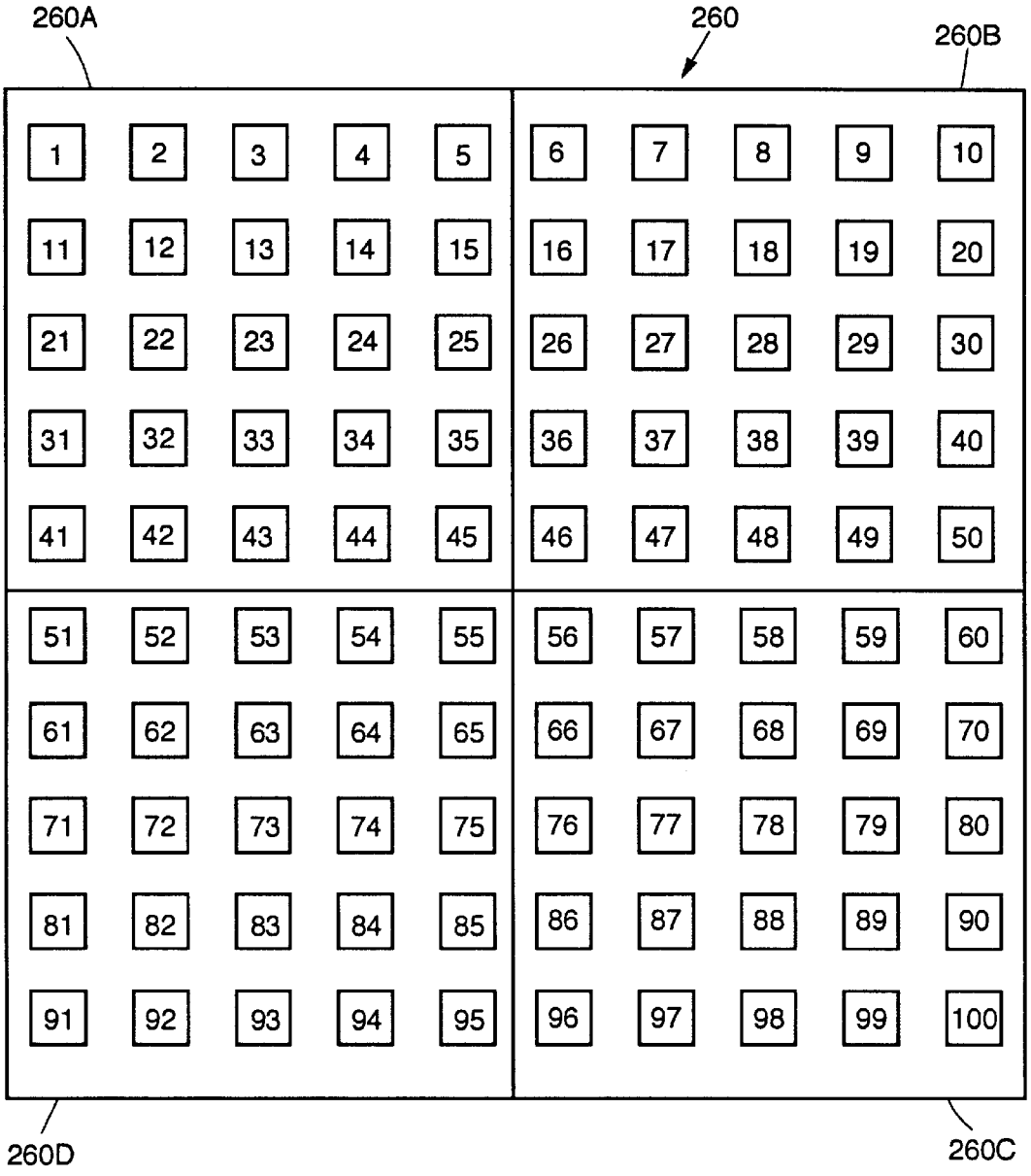
FIG. 4 illustrates in schematic form an exemplary 10×10 array of elements.

In FIG. 4, a 10×10 array 260 of elements (depicted by squares) is shown with each of the element positions numbered, and divided in quadrants 260A–260D. These element positions will be used throughout the following description. FIGS. 5–10 show numbers being repeated to demonstrate the common excitation achieved by modules after a step in the phase up process.

Figure 5:
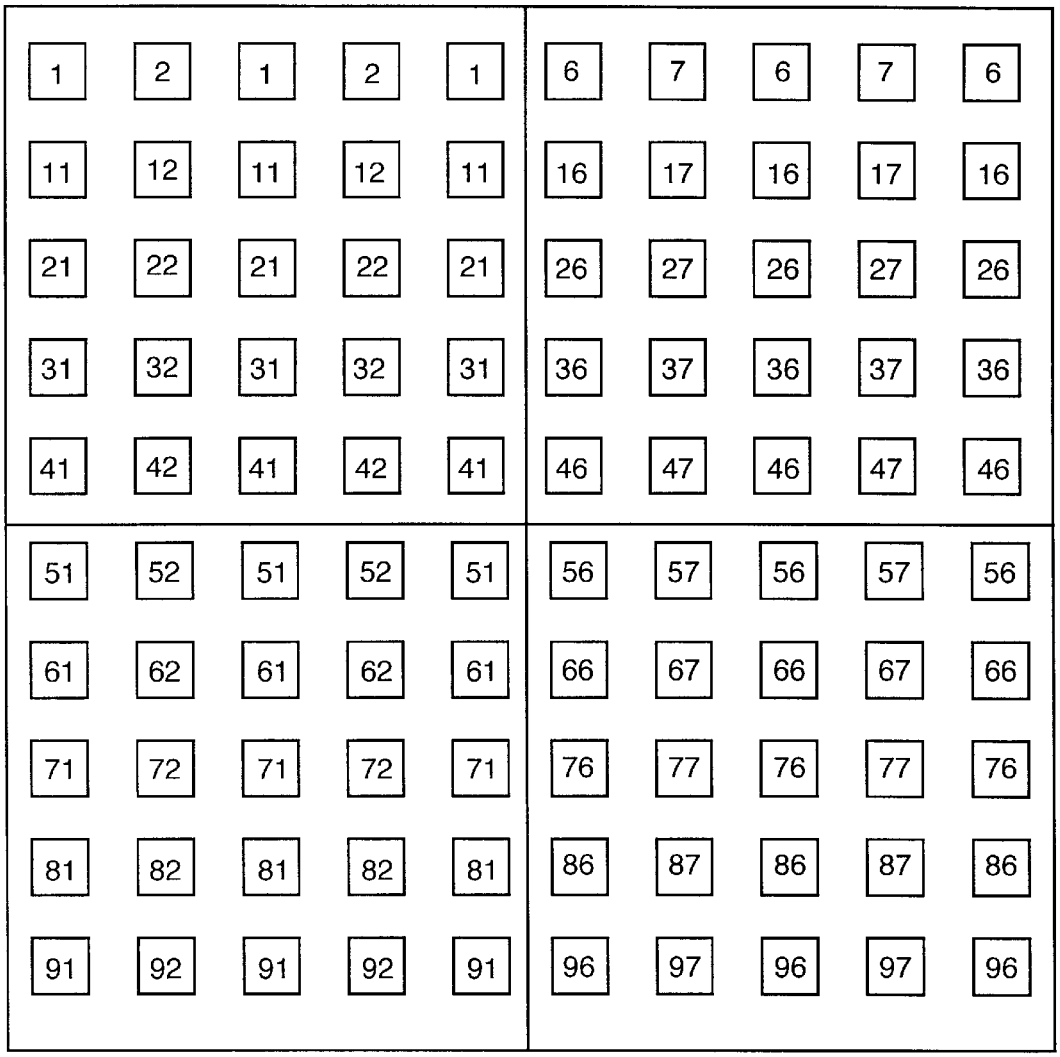
FIG. 5 depicts the array of FIG. 4 after completion of step one of an exemplary calibration process.

The first step of the calibration process is to phase up alternating modules in each row of each quadrant. To accomplish this, in the first half of this step, modules 1, 3, 5 in quadrant 260A are phased up using modules 52, 54 in quadrant 260D, modules 6, 8, 10 (quadrant 260B) are phased up using modules 57, 59 (quadrant 260C), and so on. "Phasing up" modules is defined as bringing groups of phased up modules to a common complex excitation reference. In this embodiment, this is done by adjusting the phase shifter and attenuators in the T/R modules, as is described more particularly in the referenced pending applications. The second half of the first step is to phase up modules 2, 4 (quadrant 260A) using module 53 (quadrant 260D), phase up modules 7, 9 (quadrant 260B) using module 58 (quadrant 260C), and so on. This will provide 40 common phase references, down from the 100 random phases at the start of the calibration sequence. FIG. 5 depicts the lattice 260 after completion of step one of the process. This step phases up alternating modules within a row, within each quadrant.

The second step of the calibration process is to phase up the alternating modules within each column for each quadrant. Thus, in the first half of this step, modules 5, 25, 45 (quadrant 260A) are phased up using modules 16, 36 (quadrant 260B), modules 55, 75, 95 (quadrant 260D) are phased up using modules 66, 86 (FIG. 260C), and so on. The second half of the step is to phase up modules 15, 35 (quadrant 260A) using module 26 (quadrant 260B), phase up modules 65, 85 (quadrant 260D) using module 76 (quadrant 260C), and so on. This second step provides 16 common phases. FIG. 6 depicts the lattice 260 after completion of step two of the process. This step phases up alternating modules within a column for each quadrant.

Figure 7:
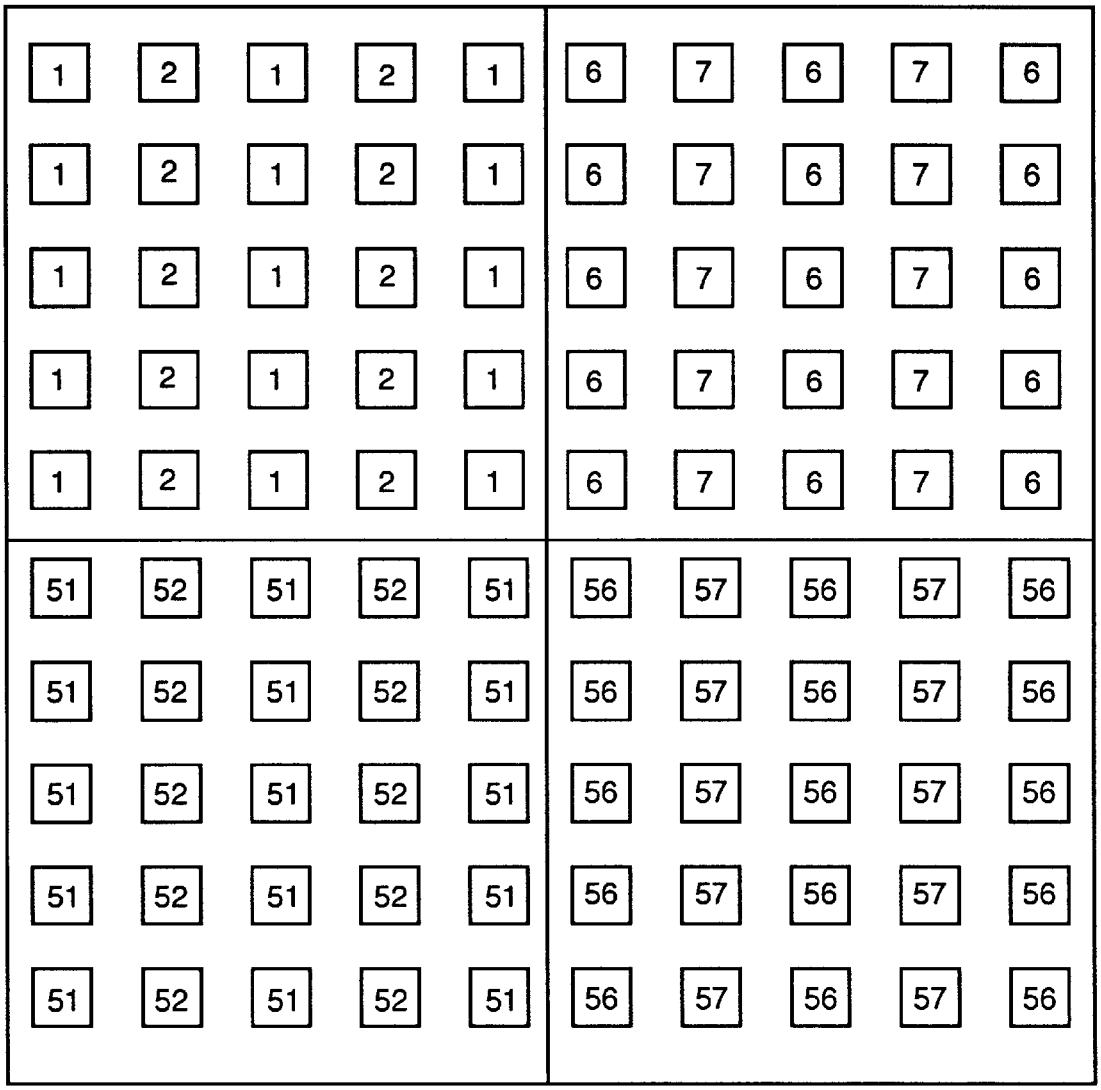
FIG. 7 depicts the array of FIG. 4 after completion of the third step of the calibration process, which provides a pair of phased columns per quadrant.

The third step of the calibration process is to complete the phasing up of modules within each column for each quadrant. This step starts with the phase up of modules 1, 11 (quadrant 260A) using modules 6, 16 (quadrant 260B) . This requires the second, 4 measurement type of process to resolve the non-symmetric path lengths and coupling coefficients between the modules. The process is also repeated on modules 2, 12 (quadrant 260A) using modules 6, 16 (quadrant 260B). A similar process is used then to phase the other quadrants similarly. The result of this step is depicted in FIG. 7.

Figure 8:
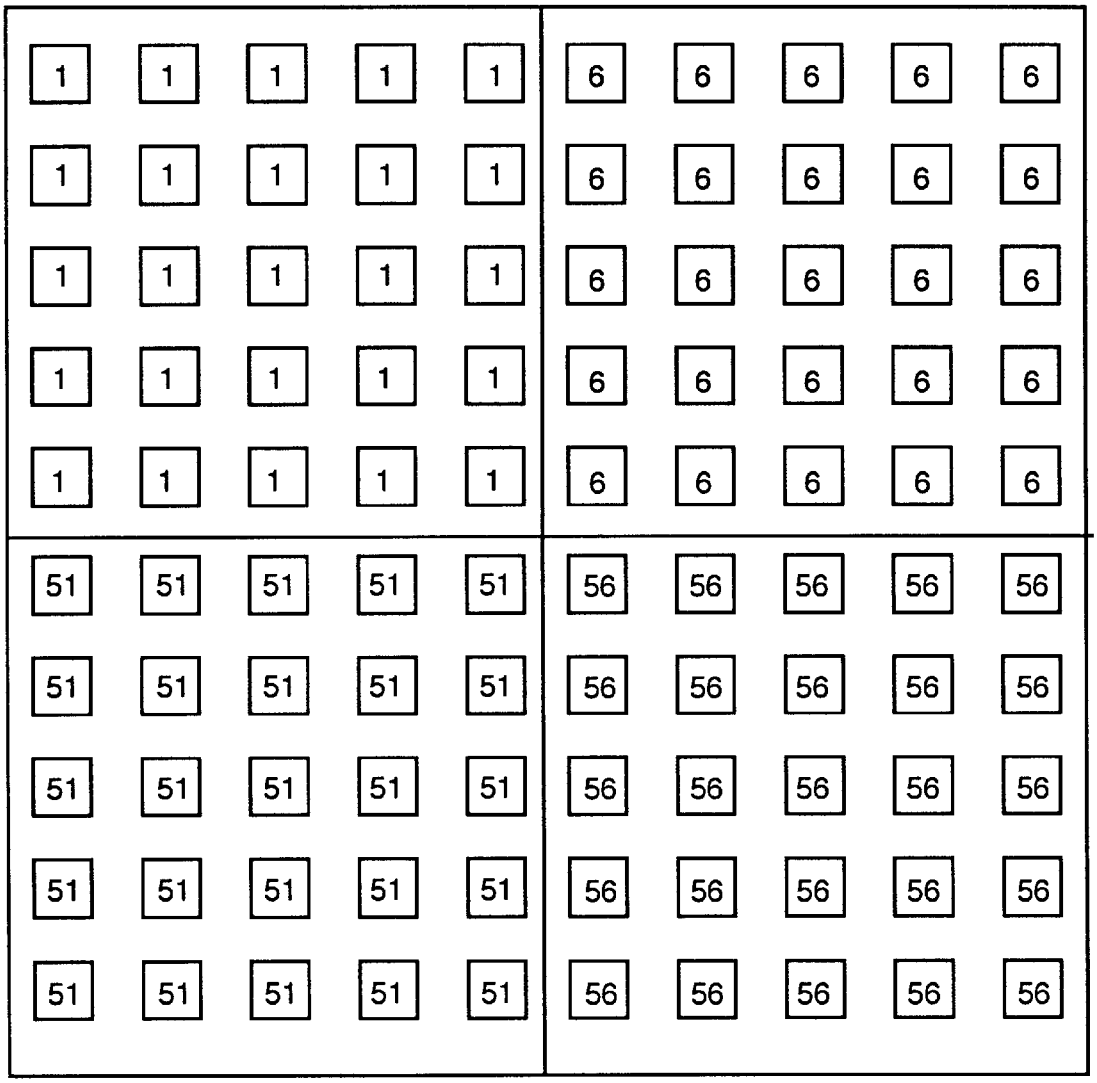
FIG. 8 depicts the array of FIG. 4 after the fourth step of the calibration process.

The fourth step of the calibration process is to use the second measurement technique (as depicted in FIG. 3) to complete the phasing of the modules in a quadrant. Modules 1, 2 (quadrant 260A) are phased up using modules 51, 52 (quadrant 260D). The process is repeated for each of the additional quadrants. The resultant phase up is depicted in FIG. 8.

Figure 9:
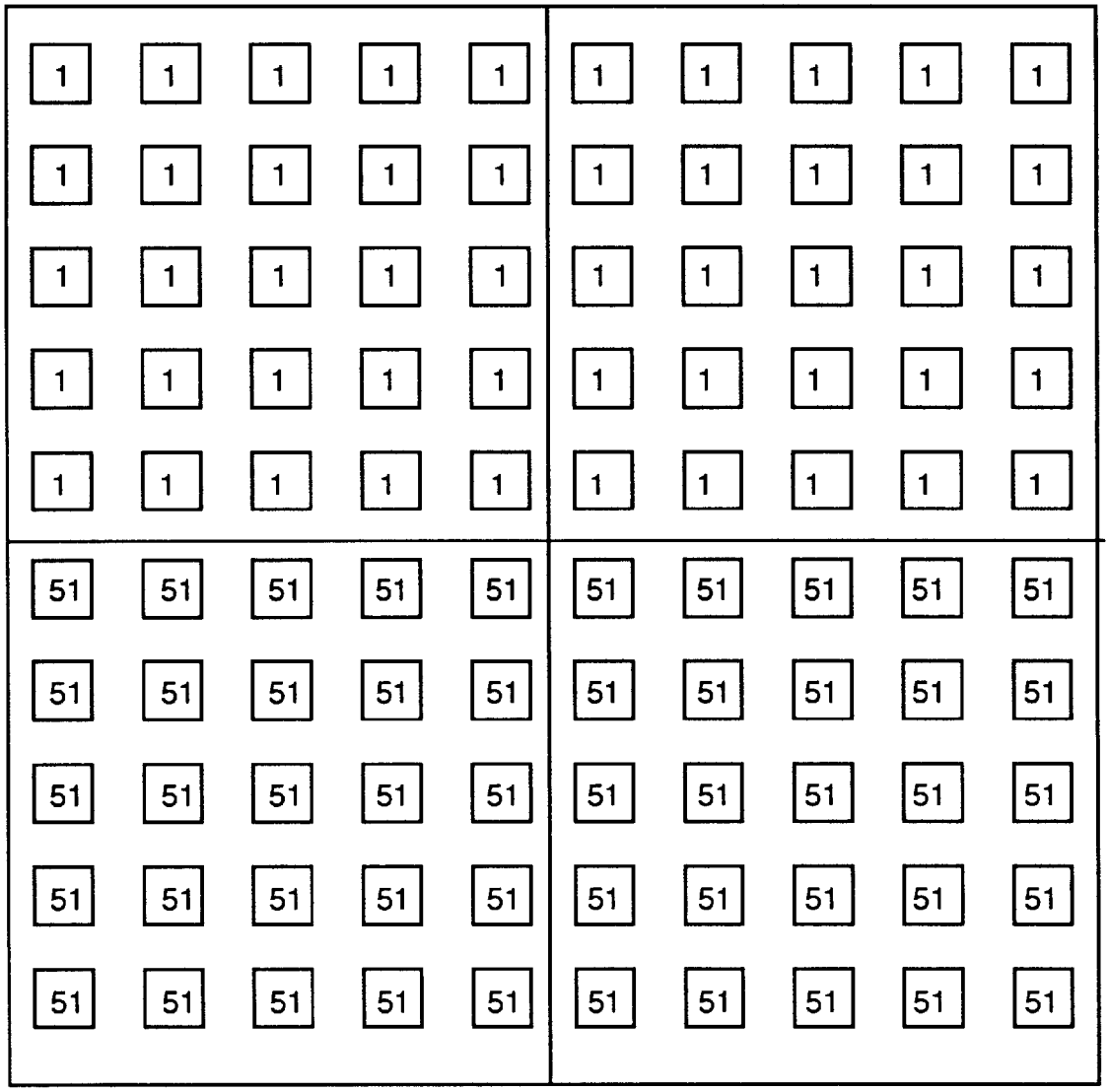
FIG. 9 depicts the array of FIG. 4 after the fifth step of the calibration process.

The fifth step of the calibration process is to use the second measurement technique (as depicted in FIG. 3) to combine quadrants into half arrays, i.e. to phase up two quadrants into a half array. Modules 5, 6 (quadrants 260A, 260B) are phased up using modules 55, 56 (quadrants 260D, 260C). Similarly, modules 55, 56 are phased using modules 5, 6. Note that this is the first time that the transmit signal is injected into two different quadrants to make the measurement. The resultant phase up is depicted in FIG. 9.

Figure 10:
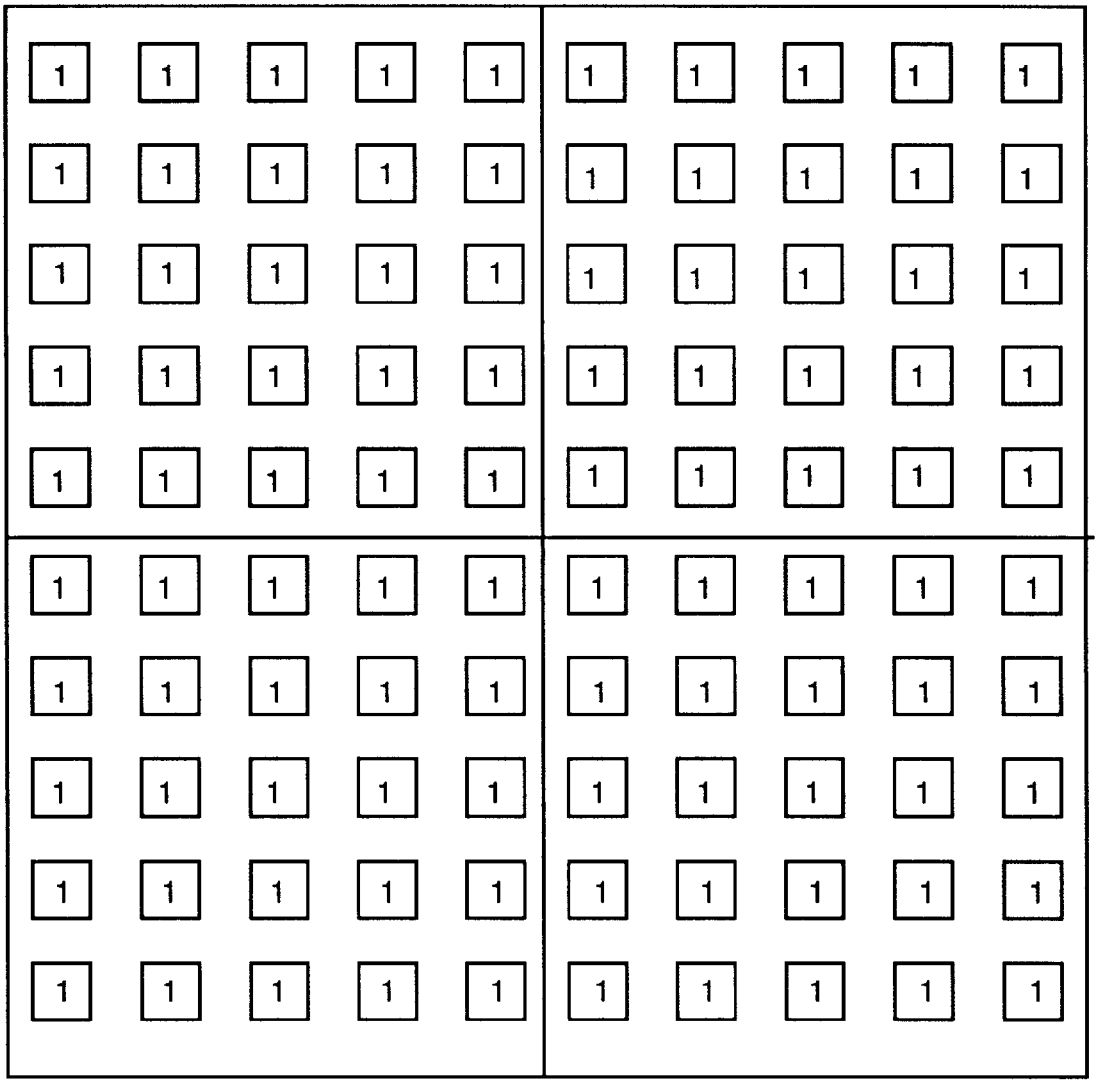
FIG. 10 depicts the array of FIG. 4 after the sixth and final step of the calibration process.

The sixth and final step of the calibration process is to use the second measurement technique (as depicted in FIG. 3) to complete the phasing of the modules in a quadrant. Modules 41, 45 (quadrant 260A) are phased up using modules 46, 56 (quadrants 260B, 260C). The resultant phase up is depicted in FIG. 10. This step phases up the two half arrays into a phased up array.

The above exemplary measurement sequence will provide a phased up array given no failures at critical module locations and no mutual coupling pattern nulls. Because of these limitations, and also because of a desire to have a multiplicity of measurements to average over for reduction of error effects, alternate transmit/receive pairings are desired.

For step one above, the reference module would not have to be just the modules on the quadrant boundary. Any module within the quadrant and column of the reference module could be used as well. For example, if module 52 (in FIG. 4) was undesirable for phasing modules 1 and 3, modules 62, 72, 82, and 92 would be acceptable substitutes. Collecting a second data set with one of these alternate modules would give a good cross check and averaging the measurements with those from module 52 would reduce the error of the measurement.

Similarly, for step two above, if module 16, used for phasing modules 1 and 21, were undesirable, modules in the same quadrant and row (i.e. modules 17, 18, 19, and 20) would work as substitutes.

For steps 3 and 4, the 4 measurement technique illustrated in FIG. 3 is used. In this case, choosing a different pair of reference modules and/or receive modules, moving vertically in step 4 or horizontally in step 3, would yield useable results. Aa an example, using any pair of reference modules 6 and 16, 7 and 17, 8 and 18, 9 and 19, 10 and 20 to phase any pair of receive modules 1 and 11, 2 and 12, 3 and 13, 4 and 14, 5 and 15 would yield satisfactory results.

Another alternative to use on the third and fourth steps is to move both the transmit and receive pair orthogonally to the direction of the signals. Specifically, the measurement to phase modules 5 and 15 using modules 6 and 16 could also be achieved using modules 16 and 26 to phase modules 15 and 25.

The final two steps, the fifth and sixth steps, require the phasing of two quadrants together. The alternative measurement requirement here is that the 4 modules used, two transmit and two receive, be placed symmetrically about the center of the array. Modules 34, 37, 64, and 67 would work just as well as 45, 46, 55, and 56.

When phasing an array, starting with the centrally located modules and moving towards the edge is a simple way of reducing cascaded error effects. It also has the corollary benefit of placing the smallest error on the center modules, which, for most amplitude weighting functions, contribute the most to the final antenna pattern.

This invention works with the assumption that the signal from one module to a pair of symmetrically placed modules to be phased is the same. Rhombic lattices and typical radiator patterns tend to exhibit this property. The property will degrade somewhat, however, due to edge effects on mutual coupling. This degradation is more tolerable in tapered aperture applications, and can be quantified and budgeted for. The problem becomes much more complicated if the signal can propagate via another avenue, such as reflections off of a radome. Characterization and mitigation of the other signals paths will need to be performed.

Isolating the desired signal from a module from the leakages of its neighbors also presents a challenge. The signal-to-leakage ratio can be improved by first simply switching off the array quadrants not involved in the test. Next, using the high-isolation, high-protection state of the modules not under test will give several tens of dBs of isolation. Finally, using a pulse-to-pulse modulation technique described in the above-referenced pending patent applications can give separation from the leakage by using Fourier processing.

Transmit phase up using full power can cause the receive circuitry of the receive reference module to overload. This can be solved by either placing a high maximum-receive-power-incident specification on the receive module (via LNA, limiter, switch, etc.), or phasing the array at low power and using command linearization tables to map the low power phase ups to high power.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A phased array antenna, comprising:

an array of radiating elements, arranged in a regular, rhombic lattice in first, second, third and fourth quadrants;

a quadrant feed network for dividing a feed signal into separate feed signals for each quadrant, the quadrant feed network including first, second, third and fourth quadrant feed transmission lines which take RF signals to and from each quadrant; and first, second, third and fourth quadrant test signal switches connected respectively in the first, second, third and fourth feed transmission lines to provide a switch function to selectively interrupt one or more of said feed transmission lines and to provide instead signal paths to a test signal generator.

2. A phased array antenna, comprising:

an array of radiating elements arranged in a regular, rhombic lattice in first, second, third and fourth quadrants;

a plurality of transmit/receive (T/R) modules, each of said T/R modules being connected to a corresponding one of the radiating elements;

a reciprocal quadrant feed network for dividing a feed signal into separate feed signals for each quadrant, the quadrant feed network including first, second, third and fourth quadrant feed transmission lines which take RF signals to and from each quadrant;

reciprocal intra-quadrant feed networks for each quadrant connected between the quadrant feed network and the T/R modules associated with a given quadrant, wherein each intra-quadrant feed network divides the quadrant feed signal into feed signals for each T/R modules comprising the corresponding quadrant;

first, second, third and fourth quadrant test signal switches connected respectively in the first, second, third and fourth feed transmission lines to provide a switch function to selectively interrupt one or more of said feed transmission lines and to provide instead signal paths to a test signal generator for array self phase-up.

* * * * *